United States Patent [19]

Yano et al.

[11] Patent Number: 4,630,812

[45] Date of Patent: Dec. 23, 1986

[54] DELIVERY DEVICE FOR SHEET BODIES

[75] Inventors: Tadashi Yano; Arifumi Okamoto, both of Mihara, Japan

[73] Assignee: Mitsubishi Jukogyo Kabushiki Kaisha, Tokyo, Japan

[21] Appl. No.: 634,863

[22] Filed: Jul. 26, 1984

[30] Foreign Application Priority Data

Aug. 5, 1983 [JP] Japan ..... 58-142428

[51] Int. Cl.[4] ..... B65H 3/64

[52] U.S. Cl. ..... 271/132; 271/99; 414/125

[58] Field of Search ..... 271/132, 102, 99; 414/125, 128; 74/107

[56] References Cited

U.S. PATENT DOCUMENTS

| | | | |
|---|---|---|---|
| 2,995,359 | 8/1961 | Gulick | 271/103 |
| 3,588,093 | 6/1971 | Ward et al. | 271/132 X |
| 3,973,768 | 8/1976 | Shannon | 271/132 X |
| 4,008,889 | 2/1977 | Ayres | 271/132 X |
| 4,181,298 | 1/1980 | Capdeboscq | 271/99 |

FOREIGN PATENT DOCUMENTS 0035428 9/1981 European Pat. Off. .

OTHER PUBLICATIONS

Hamilton, "Lubricator Actuating Mechanism", 4, 29, 1914, No. 10,554.

*Primary Examiner*—Bruce H. Stoner, Jr.
*Assistant Examiner*—Matthew C. Graham
*Attorney, Agent, or Firm*—Wenderoth, Lind & Ponack

[57] ABSTRACT

The known delivery device for sheet bodies in which sheet bodies stacked at a standby position are successively delivered one by one as kicked by a kicker, is improved in that the delivery device is additionally provided with a suction plate which sucks and conveys each sheet body as moved jointly with the kicker only during the period when the kicker moves for a predetermined distance after it has been started.

6 Claims, 5 Drawing Figures

DELIVERY DEVICE FOR SHEET BODIES

Figure 1:
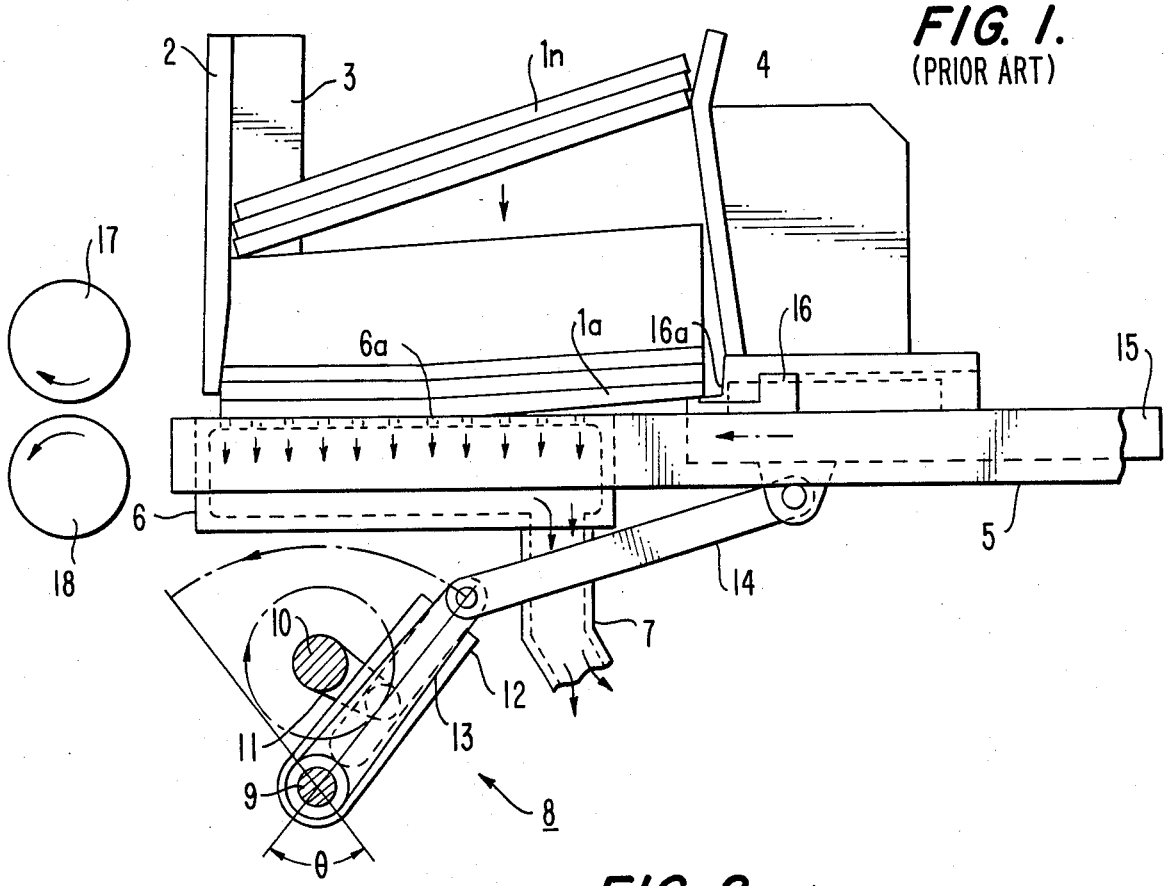
FIG. 1. (PRIOR ART)

The present invention relates to improvements in a delivery device for sheet bodies.

A delivery device for sheet bodies in which sheet bodies stacked at a standby position are successively delivered one by one as kicked by a kicker has been heretofore known. One example of such delivery devices in the prior art as applied to a cardboard sheet feeder for a corrugated cardboard box making machine will be generally described with reference to FIGS. 1 to 3.

In these figures, reference numerals (1*a*)–(1*n*) designate corrugated cardboard sheets stacked one on another, numeral (2) designates a front abutment, numeral (3) designates a side guide, numeral (4) designates a back stopper, numeral (5) designates a table, numeral (6) designates a suction box, numeral (6*a*) designates small holes, numeral (7) designates a duct, numeral (8) designates a driving device, numeral (9) designates a shaft for a lever, numeral (10) designates a shaft for a crank arm, numeral (11) designates a crank arm, numeral (12) designates a bifurcated link, numeral (13) designates a lever, numeral (14) designates a link, numeral (15) designates a slide bar, numeral (16) designates a kicker, numeral (16*a*) designates a kicker's claw, and numerals (17) and (18) designate opposed feed rolls. These members are arranged in such manner that the corrugated cardboard sheets (1*a*)–(1*n*) sent from the preceding step may fall in the space surrounded by the front abutment (2), the side guide (3) and the back stopper (4) as stacked one on another, the corrugated cardboard sheet (1*a*) at the lowermost level is kicked out in the direction of a dash-line arrow at a predetermined timing by means of the kicker (16) which is actuated by the driving device (8), then it is pinched between the upper and lower feed rolls (17) and (18) which are rotating at the same peripheral velocity as the velocity of the kicker (16), and it is adapted to be delivered to the subsequent step of the process owing to frictional forces exerted by the feed rolls (17) and (18).

Here, it is to be noted that the corrugated cardboard sheets (1*a*)–(1*n*) falling in the space surrounded by the front abutment (2), the side guide (3) and the back stopper (4) are not always flat ones only, and hence when those warped upwardly or downwardly are going to be kicked out by the kicker (16), sometimes miskick may arise due to the warp. In order to avoid such miskick, one or a plurality of suction boxes (6) having a large number of small holes (6*a*) in their ceilings are provided as juxtapositioned in the widthwise direction of the delivery device along the upper surface of the table (5) which is in turn supported from a frame (not shown), and by evacuating the suction box (6) through the duct (7) and a blower (not shown) the corrugated cardboard sheet (1*a*) at the lowest level is sucked by the suction box (6) and thereby can be conveyed along the table (5) while maintaining a flat state.

Figure 3:
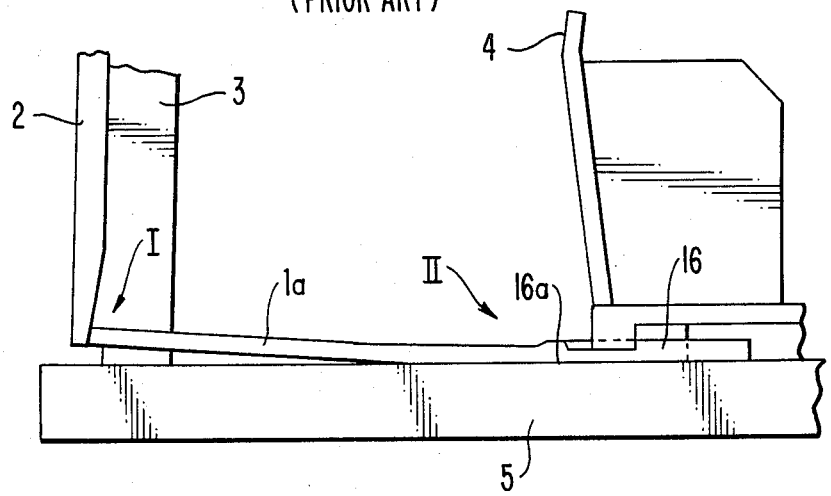
FIG. 3. (PRIOR ART)

In the above-described cardboard sheet feeder for a corrugated cardboard box making machine, if the suction effect of the suction box (6) is too weak, reforming of the warp of the corrugated cardboard sheet (1*a*) becomes insufficient, and so, the front end surface of the corrugated cardboard sheet (1*a*) would strike against the front abutment (2) as shown at I in FIG. 3, whereas if the suction effect is too strong, a slide resistance between the corrugated cardboard sheet (1*a*) and the upper surface of the table (5) becomes large and hence buckling and/or separation would be generated by the kicker's claw (16*a*) at the rear end surface (at II in FIG. 3) of the corrugated cardboard sheet (1*a*). These phenomena are especially liable to occur frequently in the case of low grade paper sheets or soft corrugated cardboard sheets, and they were one cause for degrading productivity. The present invention has been worked out as a counter-measure for resolving the above-mentioned problems in the prior art.

It is therefore one object of the present invention to provide an improved delivery device for sheet bodies in which the phenomenon of a front end surface of a sheet body striking against a front abutment as well as the buckling and/or separation generated at a rear end surface of a sheet body can be prevented.

According to one feature of the present invention, there is provided a delivery device for sheet bodies which comprises a kicker for kicking out a sheet body at a standby position, and a suction plate adapted to suck and convey the sheet body as moved jointly with the kicker only during the period when the kicker moves for a predetermined distance after it has been started.

Figure 2:
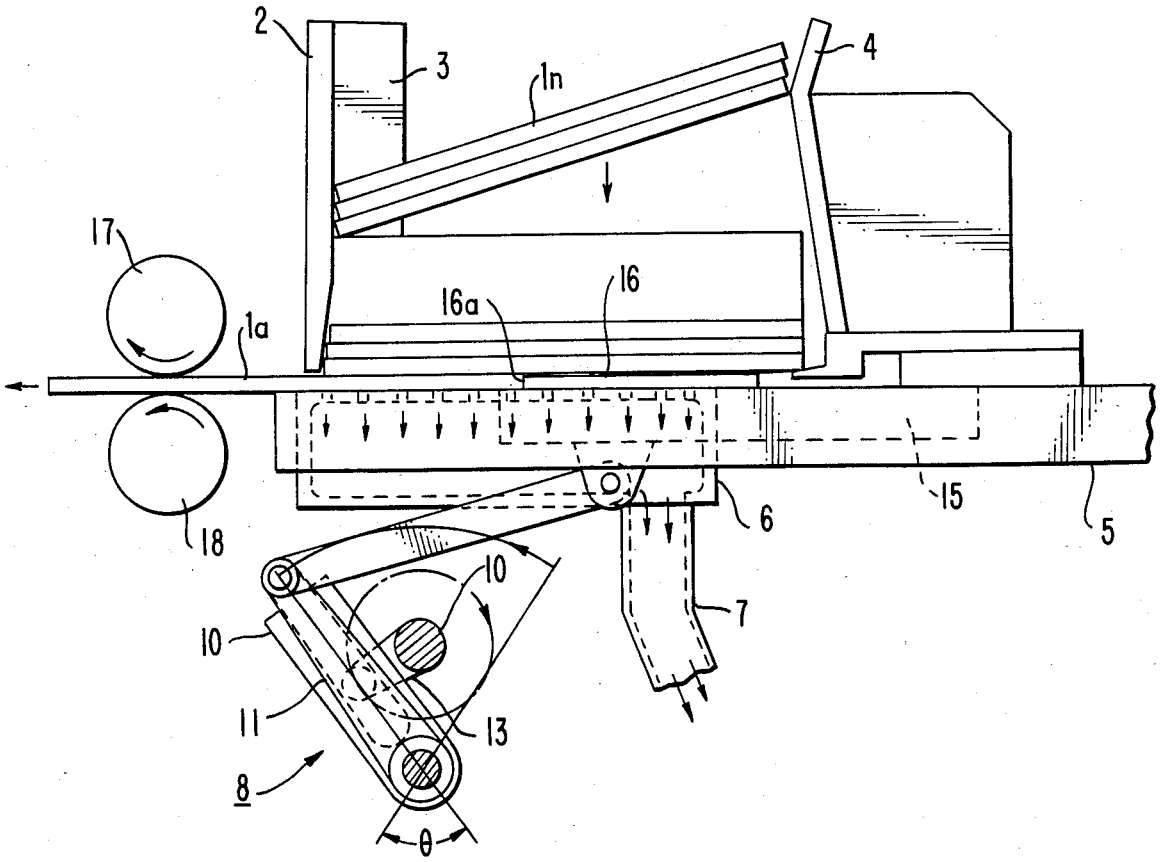
FIG. 2. (PRIOR ART)
Figure 4:
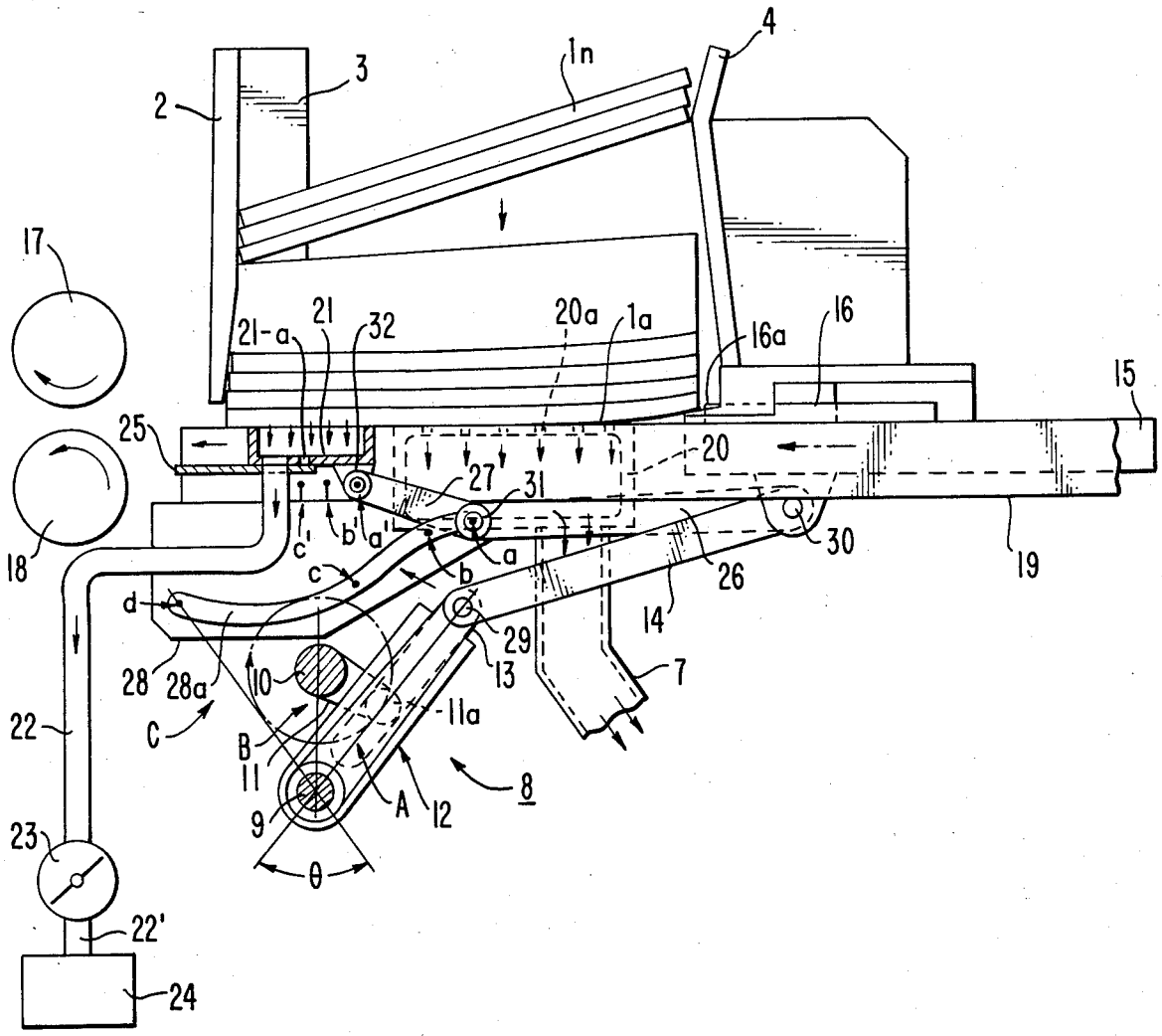
Figure 5:
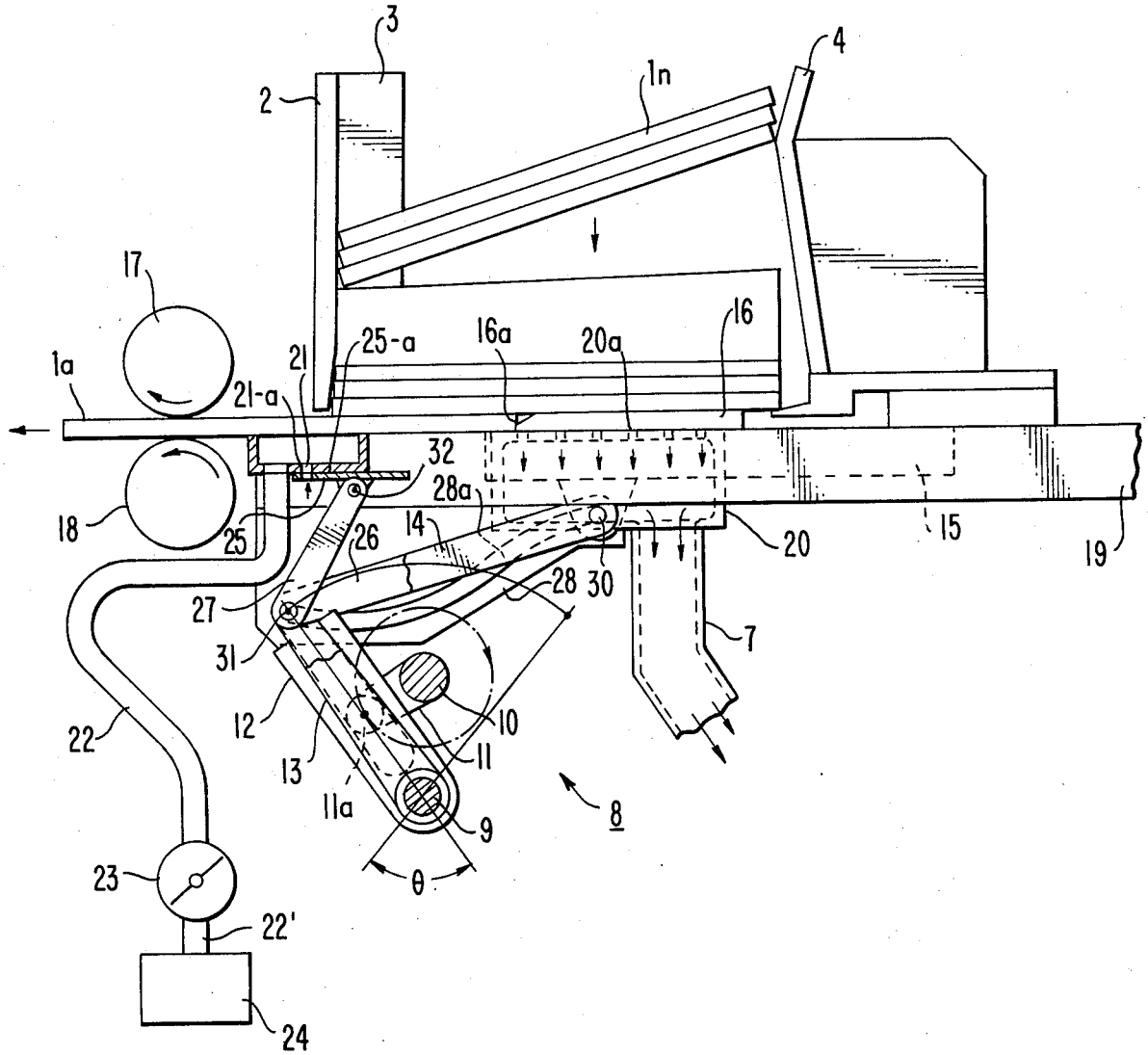

The above-mentioned and other features and objects of the present invention will become more apparent by reference to the following description of one preferred embodiment of the invention taken in conjunction with the accompanying drawings, wherein:

FIGS. 1 and 2 are schematic side views showing a delivery device for sheet bodies in the prior art in different states of operation, FIG. 3 is a schematic view to be used for explaining problems associated with the delivery device for sheet bodies in the prior art, FIG. 4 is a schematic side view showing one preferred embodiment of a delivery device for sheet bodies according to the present invention in the state of going to kick out one sheet body, and FIG. 5 is a schematic side view showing the same delivery device but in the state after one sheet body has been kicked out.

Referring now to FIGS. 4 and 5 which illustrate one preferred embodiment of the present invention, reference numerals (1) to (4) and (7) to (18) designate component parts identical to those given like reference numerals in the prior art device shown in FIGS. 1 to 3, reference numeral (19) designates a table, numeral (20) designates a suction box, numeral (21) designates a suction plate, numeral (21-*a*) designates an air intake hole, numerals (22) and (22') designate hoses, numeral (23) designates a rotary valve, numeral (24) designates a vacuum pump, numeral (25) designates a suction partition plate, numeral (25-*a*) designates an air intake hole, numeral (26) designates a link, numeral (27) designates another link, numeral (28) designates a cam, numeral (28*a*) designates a guide slot, and numerals (29), (30), (31) and (32) designate respective pivot pins. A front abutment (2), a side guide (3), a back stopper (4), a driving device (8), a slide bar (15), a kicker (16) and feed rolls (17) and (18) are constructed in a similar manner to the corresponding component parts in the prior art device shown in FIGS. 1 to 3. In addition, one or plurality of suction boxes (20) having a large number of small holes (20*a*) in their ceilings are provided as juxtapositioned in the widthwise direction of the delivery device (in the direction perpendicular to the sheet of the drawing) along the upper surface of the table (19), and these suction boxes (20) are connected via a duct (7) to a blower (not shown).

Furthermore, on the front side of the suction box (20) is provided a suction plate (21) which can slide in the front and rear directions within the table (19). This suction plate (21) is connected to a vacuum pump (24) through a hose (22), a rotary valve (23) and another hose (22'). In addition, beneath the suction plate (21) is provided a suction partition plate (25). A driving device (8) is constructed of shafts (9) and (10) rotatably supported at their opposite ends from left and right machine frames (not shown), a bifurcated link (12) and a lever (13), and the lever (13), the link (14) and the kicker (16) fixedly secured to the slide bar (15) are pivotably coupled to one another by means of the pivot pins (29) and (30). In addition, the slide bar (15), the links (26) and (27) and the suction plate (21) are pivotably coupled to one another in succession by means of the pivot pins (30), (31) and (32). On the bottom surface of the table (19) is fixedly secured a cam (28), and a guide slot (28*a*) formed in the cam (28) is engaged with the pivot pin (31).

Now description will be made on the operation of the above-described delivery device for sheet bodies. FIG. 4 shows the state just before the sheet (1*a*) at the lowest level in a group of corrugated cardboard sheets (1*a*) to (1*n*) stacked on the table (19) is kicked out. In FIG. 4, the interior of the suction box (20) is connected to a blower (not shown) through the duct (7), and hence it is evacuated by the blower (7). At this moment, the air intake hole (21-*a*) of the suction plate (21) is blocked by the suction partition plate (25), while the rotary valve (23) is in an opened state, hence the interior of the suction plate (21) is communicated with the vacuum pump (24) through the hose (22), the rotary valve (23) and the hose (22'), and so, it is held in a vacuum state by the operation of the vacuum pump (24). Accordingly, the front end portion of the corrugated cardboard sheet (1*a*) is sucked by the suction plate (21), while the rear half portion of the corrugated cardboard sheet (1*a*) is sucked by the suction box (20), and thereby the corrugated cardboard sheet (1*a*) is brought into tight contact with the upper surface of the table (19).

FIG. 5 shows the state where the corrugated cardboard sheet (1*a*) shown in FIG. 4 has been fed between the feed rolls (17) and (18) with its front end portion conveyed by the suction plate (21) and at the same time with its rear end surface kicked out by the kicker (16). More particularly, with reference to FIG. 5, since the crank arm (11) of the driving device (8) is always rotationally driven in the direction of an arrow by the driving of the shaft (10), the center of a crank shaft (11*a*) would continuously revolve along a circular locus depicted by a broken line. Owing to the revolution of the crank shaft (11*a*), the bifurcated link (12) would repeatedly swing in the back and forth directions about the shaft (9) within the range of an angle $\theta$, jointly with the lever (13). FIG. 5 shows the state where the lever (13) has tilted forwardly by an angle $\theta$ from the state shown in FIG. 4. The link (14), the slide bar (15) and the kicker (16) also take the illustrated positions following the swing motion of the lever (13). Then, the lever (26) is projected forwardly (leftwardly in the figure) as pushed by the pivot pin (30), and the pivot pin (32) advances the suction plate (21) via the link (27) and the pivot pin (31) as guided by the guide slot (28*a*), so that the suction plate (21) moves the corrugated cardboard sheet (1*a*) forwardly while sucking the front end portion thereof. After the front end of the same corrugated cardboard sheet (1*a*) has passed through the gap space between the front abutment (2) and the table (19) and has moved for a predetermined distance, the evacuation for the suction plate (21) is interrupted by closing the rotary valve (23), also the interior of the suction plate (21) is communicated with the atmosphere through the air intake hole (21-*a*) of the suction plate (21) and the air intake hole (25-*a*) of the suction partition plate (25), hence the corrugated cardboard sheet (1*a*) is released from the suction effect of the suction plate (21), and it is fed to the feed rolls (17) and (18) as kicked out by the kicker (16).

Here, for the purpose of facilitating understanding of the operation of the illustrated delivery device, the operations of the kicker (16) and the suction plate (21) until the corrugated cardboard sheet (1*a*) has been fed to the feed rolls (17) and (18) will be further explained supplementarily with reference to FIG. 4. The kicker (16) is engaged with the rear end surface of the corrugated cardboard sheet (1*a*), thereafter the moving speed of the kicker (16) is accelerated by the motion of the lever (13) in the driving device (8) (due to the crank characteristic), and it is kept engaged with the corrugated cardboard sheet (1*a*) until the tip end of the corrugated cardboard sheet (1*a*) is nipped by the feed rolls (17) and (18) (at this moment the position of the lever (13) having been shifted from A to B). Thereafter, the corrugated cardboard sheet (1*a*) is conveyed by the feed rolls (17) and (18). After the corrugated cardboard sheet (1*a*) has been delivered to the feed rolls (17) and (18), the kicker (16) is decelerated and reaches the end of the stroke (at this moment the position of the lever (13) having been shifted from B to C), and subsequently it begins to return. During the above-mentioned stroke of the kicker (16), when the lever (13) moves from the position A to the position B, the suction plate (21) is moved via the links 26 and 27 from the position a' to the position b' at the same speed as the kicker (16) (during this period the position of the pivot pin (31) being shifted from a to b). At the point b' the suction effect of the suction plate (21) is interrupted, and so the suction for the corrugated cardboard sheet (1*a*) is stopped. Thereafter, during the period when the pivot pin (31) moves from the position b to the position c (the suction plate (21) being moved from the position b' to the position c'), the suction plate (21) is decelerated due to the fact that the pivot pin (31) moves along the guide slot (28*a*), and the movement of the suction plate (21) is stopped at the position c'. Subsequently, the pivot pin (31) moves along the guide slot (28*a*) (from the position c to the position d). During that period, the suction plate (21) is held stopped. In the backward stroke, on the contrary to the forward stroke the suction plate (21) begins to be drawn back after the pivot pin (31) has returned to the position c. By repeating the above-described operations, the corrugated cardboard sheets (1*a*) to (1*n*) stacked in the sheet feed section are continuously delivered one by one to the subsequent step of the process.

Since the delivery device for sheet bodies according to the present invention is constructed in the above-described manner, the following effects and advantages can be obtained:

(I) The front end portion of the corrugated cardboard sheet (1*a*) can pass under the lower edge of the front abutment (2) as sucked by the suction plate (21), also owing to the fact that the suction plate (21) moves while sucking the corrugated cardboard sheet (1*a*), a strong suction force can be introduced without increasing the slide resistance between the corrugated cardboard sheet (1*a*) and the upper surface of the table (19) which became an issue in the prior art, and therefore, reforming of the warp is achieved reliably and the phenomenon of the corrugated cardboard sheet (1*a*) striking against the front abutment (2) as shown at I in FIG. 3 would not occur.

(II) A kick-out impact force applied to the rear end surface of the corrugated cardboard sheet (1*a*) by the kicker (16) is reduced by the amount corresponding to the conveying force by the suction plate (21), and since reforming of the warp is effected also by the suction plate (21), the suction force of the suction box (20) can be weakened, hence the slide resistance between the corrugated cardboard sheet (1*a*) and the upper surface of the table (19) is reduced, so that the phenomena of crushing and/or separation at the rear end surface (at II in FIG. 3) of the corrugated cardboard sheet (1*a*) caused by the kicker's claw (16*a*), which have been often observed especially in the case of a soft low-grade paper sheet in the prior art, could be eliminated.

(III) Moreover, since it is possible to interrupt the suction effect and stop the movement of the suction plate (21) when the suction plate (21) has moved for a necessary distance relative to the stroke of the kicker (16), there is an advantage that interference of the suction plate (21) with the feed rolls (17) and (18) as well as the load of the driving system for the kicker (16) can be reduced.

While the present invention has been described above in connection to one preferred embodiment thereof, it is a matter of course that the invention should not be limited only to the illustrated embodiment but various changes and modifications in design could be made thereto without departing from the spirit of the present invention.

What is claimed is:

1. A delivery device for sheet bodies comprising:

a kicker which is adapted to engage an end of a single sheet which is at a standby position, and move said sheet to a position away from said standby position, after which said kicker returns to said standby position;

a movable suction plate connected to a source of vacuum which engages at least a portion of said sheet and is movable in cooperation with said kicker to a predetermined position and stops at said position while said kicker continues to move said sheet, said suction plate being pivotably coupled to said kicker by means of linkage, a cam, a guide slot in said cam and a pivot pin attached to said linkage and arranged to follow the path of said slot for causing said suction plate to travel at a decelerated rate of speed as said suction plate approaches said predetermined position;

means for simultaneously moving said kicker and said suction plate away from said standby position and for moving said suction plate to said predetermined position and said kicker to said position away from said standby position; and means for removing the suction applied by said suction plate when said plate reaches said predetermined position, whereby said sheet is moved by only said kicker after said movable suction plate reaches said predetermined distance.

2. A device of claim 1 wherein said pivot pin cooperates with said linkage and said guide slot to move said suction plate to stop at said predetermined position, after which the pivot pin continues to follow said guide slot without causing said suction plate to move.

3. The device of claim 1 wherein said means for removing the suction applied to said movable suction plate includes a rotary valve for interrupting the vacuum source applied to said suction plate at a position between the starting position of said suction plate and said predetermined position.

4. The device of claim 3 wherein said means for removing suction further includes means connecting said movable suction plate with the atmosphere when said movable suction plate is in said predetermined position.

5. The device of claim 1 wherein said moving means comprises a single power source connected by linkage to said movable suction plate and said kicker, said linkage arranged to allow said movable suction plate to stop at a predetermined position while said kicker continues to move said sheet to said position away from said standby position.

6. The device of claim 1 which further comprises at least one stationary suction box which is adapted to apply a vacuum force to said sheet throughout the delivery cycle of said kicker.

* * * * *